US005641117A

United States Patent [19]

Barker et al.

[11] Patent Number: 5,641,117

[45] Date of Patent: Jun. 24, 1997

[54] FOLDABLE CONTAINER AND METHOD FOR FORMING SAME

[76] Inventors: James Joseph Barker, 8612 Wilkinson Blvd., Charlotte, N.C. 28214; Charles A. Walker, III, 3536 Fielding Ave., Charlotte, N.C. 28211; Denise Walker, 1333 St. Julian St., Charlotte, N.C. 28205; Ralph E. Barker, Jr., 8612 Wilkinson Blvd., Charlotte, N.C. 28214

[21] Appl. No.: 401,090

[22] Filed: Mar. 8, 1995

[51] Int. Cl.[6] ..... B65D 5/36; B65D 5/40

[52] U.S. Cl. ..... 229/110; 4/259; 229/114; 229/117.05; 229/193; 229/405

[58] Field of Search ..... 229/110, 114, 229/117.05, 193, 400, 405; 4/258, 259, 261

[56] References Cited

U.S. PATENT DOCUMENTS

| | | | |
|---|---|---|---|
| 709,164 | 9/1902 | Langhorne . | |
| 807,293 | 12/1905 | Lee . | |
| 965,276 | 7/1910 | Brooke | 4/259 |
| 1,478,838 | 12/1923 | Reifsnyder | 229/400 |
| 1,738,782 | 12/1929 | Main | 229/405 |
| 1,892,715 | 1/1933 | Wellman | 229/193 |
| 1,941,635 | 1/1934 | St. John . | |
| 1,980,953 | 11/1934 | Kilmer | 4/259 |
| 3,726,469 | 4/1973 | Koehler . | |
| 4,094,457 | 6/1978 | Spillson . | |
| 4,252,264 | 2/1981 | Herbst et al. | 229/400 |
| 4,470,540 | 9/1984 | Koltz | 229/114 |
| 4,867,374 | 9/1989 | Murray et al. . | |
| 4,908,882 | 3/1990 | Williams et al. | 4/261 |
| 5,492,269 | 2/1996 | Sung | 229/405 |

FOREIGN PATENT DOCUMENTS

| | | | |
|---|---|---|---|
| 158551 | 8/1954 | Australia | 229/110 |

*Primary Examiner*—Gary E. Elkins
*Attorney, Agent, or Firm*—Shefte, Pinckney & Sawyer

[57] ABSTRACT

A foldable hand-held container includes a generally frusto-conical body formed from a single sheet of foldable material having two opposed inner wall members and two opposed outer wall members each having a plurality of panels defined by a plurality of diverging, equidistant fold lines. The container may be lined with a superabsorbent material to allow the container to be used as a cuspidor. A method for forming such a container is also disclosed.

29 Claims, 6 Drawing Sheets

FOLDABLE CONTAINER AND METHOD FOR FORMING SAME

BACKGROUND OF THE INVENTION

The present invention relates broadly to paperboard, hand-held containers and, more specifically, to a foldable, hand-held container having a self-supporting frusto-conical, or tapered, body, that is substantially impervious to leaks and can be lined with a superabsorbent material and used as a cuspidor.

Portable, hand-held containers are desirable for a number of reasons. Initially, a portable and collapsible container can provide a receptacle to hold a drink of water for use in administering medication or to quench one's thirst. Essentially, all hand-held containers are portable, however, most drinking containers are not easily stored. Any such container must have a body portion which defines a liquid receiving cavity sufficient in size to hold an acceptable amount of liquid. On the other hand, to be portable in a manner herein described, the container needs to be collapsible in that its liquid receiving cavity may be reduced in volume sufficiently to allow the cup to be stored in a pocket or other confined area that provides a minimum amount of space for a generally flat object.

In response to such a need, several hand-held, collapsible paper containers have been developed. Early attempts fail to provide the advantages of the present invention. For example, in U.S. Pat. No. 1,690,586 to Main, a collapsible paper cup is disclosed to be formed from a blank of stock material. The Main '586 cup has a tapered, easily held body that is not self-supporting and is not impervious to fluid leaks, especially at the seams. Another tapered cup, disclosed in U.S. Pat. No. 2,323,287 to Amberg can be prone to leakage due to its seams and single wall construction. Another cup is disclosed in U.S. Pat. No. 4,867,374 to Murray et al which does not include a tapered body portion and, while being somewhat self-supporting, is self-supporting in an apparently unstable manner. As seen in FIG. 1, the support walls do not extend substantially around the lower perimeter of the container thereby placing the container in an unstable condition when standing upright and when it is loaded. In addition, the outer walls of Murray et al cup fail to extend fully around the body of the container and the container is not tapered. In combination with the foregoing, its hexagonal shape provides a cup which is dissimilar from conventional, non-collapsible cups.

Additionally, the in the past, disposable containers have been fitted with an absorbent material to absorb any sort of oral discharge deposited therein. This type of container is exemplified in U.S. Pat. No. 869,515 to Potter which discloses a rectangular folding container having cotton or some similar absorbent disposed therein. These types of containers were popular around the turn of the century when tuberculosis was far more active than today and sufferers needed a repository for the coughed-up by-products of their disease. These cups were not intended for use with oral tobacco products.

Modern spittoons, or cuspidors, are exemplified by U.S. Pat. No. 4,858,250 to Lee which is a non-collapsible container having a molded block of hydrophilic polymer disposed therein. The polymer is intended for the absorption of tobacco juice. A more complicated spittoon is disclosed in U.S. Pat. No. 4,908,882 to Williams et al, which includes a lidded container of fixed size having an absorbent material disposed in the bottom thereof.

SUMMARY OF THE INVENTION

It is accordingly an object of the present invention to provide a foldable, hand-held container which may function as either a cup or a spittoon and addresses the above-discussed problems.

More specifically, it is an object of the present invention to provide a foldable, hand-held container having a generally frusto-conical body and being formed from a single sheet of foldable material in a manner that will provide a tapered cup which is substantially impervious to leaks and is self-standing in an upright condition.

To that end, a foldable hand-held container preferably includes a generally frusto-conical body formed from a sheet of foldable material including two opposed inner wall members having a plurality of fold lines formed therein defining a plurality of quadrilateral panels and a polygonal bottom portion having a plurality of generally parallel side fold lines and a plurality of converging end fold lines with a wall panel projecting outwardly from each of the side fold lines and end fold lines with the wall panel defining fold lines extending in a substantially equidistant diverging relationship to distal ends of the panels, with the outer ends forming a contiguous container rim and defining a container access opening thereat. A primary fold line is provided to define a primary fold axis while generally bisecting the bottom portion. A pair of sealing flaps is provided with one flap projecting laterally outwardly from each of the inner wall members with a fold line extending between each sealing flap and the wall member associated therewith. Further, the container includes at least one outer wall member projecting laterally outwardly from at least one of the inner wall members and being adhered to and juxtaposed with the inner wall members with the sealing flaps disposed between at least one outer wall member and the inner wall members for substantially sealing a junction between at least one outer wall member, the inner wall members, and the bottom portion for rendering the container substantially impervious to leaks, the container being foldable between a closed condition for non-use and an open condition for use. Preferably, the container is configured for use as a cuspidor and includes an absorbent arrangement fixed to at least one of the inner wall panels or bottom portion for absorbing and retaining any tobacco discharge deposited in the container.

Preferably, the bottom portion includes a plurality of bottom panels with at least one of the bottom panels being oriented substantially horizontally when the container is oriented substantially upright in the open condition and may include the absorbent arrangement affixed thereto. It is preferred that the absorbent arrangement be a superabsorbent material for substantially solidifying liquid discharged into the container and is fixed to the inner wall members and the bottom portion in a predetermined pattern. Preferably, the predetermined pattern extends intermediate the fold lines.

The bottom defining fold lines preferably converge to a point along the primary fold axis with the sealing flap fold lines converging to the point and a portion of the sealing flap extending along the primary fold line from the point to an end of the sealing flap at an inclined angle when the container is in the open condition. Preferably, the bottom portion includes a plurality of panels with at least one of the panels being oriented substantially horizontally when the container is oriented substantially upright in the open condition and two of the panels being contiguous with the horizontally oriented panel and projecting angularly downwardly from the horizontally oriented panel to the point.

Preferably, the outer wall member projects beyond the bottom portion to form a substantially continuous base rim for supporting the container in a generally upright condition on a support surface. It is further preferred that each inner wall member include an outer wall member extending laterally therefrom with each outer wall member including three panels defined by diverging fold lines formed in each of the outer wall members with the diverging fold lines extending in a substantially equidistant, spaced relationship from the bottom portion to the rim with each outer wall member being in abutment with each inner wall member.

Preferably, the container is formed of paper stock and includes a lining fixed to the inner wall members with the lining being formed from a material substantially impervious to liquid penetration.

The container further includes an arrangement for conveying information associated with the container body, including indicia imprinted on at least one outer wall member for advertising purposes.

Preferably, the present invention further includes a blank of foldable sheet material for forming a hand-held foldable container having a generally frusto-conical body. The blank includes two inner wall members joined by a primary fold line, with each inner wall member formed from a plurality of outer, center, and inner panels with the panels being defined by diverging fold lines. The diverging fold lines extend in a spaced, equidistant relationship from the primary fold line to an end portion of the inner wall panel.

It is preferred that the blank also include a bottom portion formed in the inner wall members and defined by a plurality of interconnected side fold lines and end fold lines, the end fold lines intersecting the primary fold line and the side fold lines extending between the end fold lines. Further, the blank includes at least one outer wall member extending outwardly from at least one of the inner wall members and includes a plurality of panels, each panel being defined by a plurality of diverging fold lines extending in a spaced, equidistant relationship across the outer wall panel from bottom to rim. Two sealing flaps extend outwardly from each inner wall panel and are joined thereto along a sealing fold line, each sealing fold line extending in a spaced equidistant diverging relationship with one of the panel fold lines, the sealing flap being joined to the primary fold line adjacent the bottom portion. The blank is foldable along the primary fold line to bring the inner wall panels into juxtaposition to define a tapered cavity therebetween with the bottom portion extending therebetween with the sealing flaps being reverse foldable along the sealing fold line to bring the flaps into abutment with the inner wall members. The outer wall members are foldable across the inner wall members with the sealing flaps disposed intermediate the inner wall members and the outer wall members to define a foldable hand-held container. Preferably, the panels and the sealing flaps include an adhesive applied thereto to retain the container in a folded container-forming condition substantially impervious to leaks.

It is further preferred that the inner wall members and the bottom portion include a layer of absorbent material adhered thereto and disposed therealong to be within the tapered cavity to provide a container for use as a cuspidor with the absorbent material being for the absorptive retention of oral discharge material deposited into the container.

It is preferred that the blank include two outer wall members, one outer wall member extending from each of the inner wall members and joined thereto along edge fold lines, with the edge fold lines extending in a spaced, equidistant relationship with the subpanel fold lines, the outer wall members curving laterally away from each respective inner wall member and being folded across opposing inner wall members when forming the container. Preferably, the outer wall members extend beyond the side fold lines forming the bottom portion when the blank is in the folded condition to form support walls for supporting the container in an upright disposition.

The present invention further provides a method for forming an hand-held container having a generally frusto-conical body comprising the steps of providing a blank of foldable sheet material configured in the above-discussed manner; applying an adhesive to the sealing flaps and to predetermined portions of the wall members; folding the blank along the primary fold line to bring the inner wall members into juxtaposition; folding the at least one outer wall member across the inner wall members with the sealing flaps disposed intermediate the inner wall member and the at least outer wall member with the inner wall members, the at least one outer wall member and the sealing flaps adhered to one another to form a container having a substantially flat folded condition for non-use and an open condition for use.

The method preferably further includes the steps of applying an adhesive material to the sealing flaps prior to folding the at least one outer wall member across the inner wall members and further preferably includes the steps of applying an adhesive material to an inner surface of at least one of the inner wall members in a predetermined adhesive pattern and applying an absorbent material to the adhesive pattern with the application steps being performed prior to folding the blank. The method further preferably includes the step of applying an absorbent material and an adhesive material to an inner surface of at least one of the inner wall members, the bottom portion or both in a predetermined pattern. The adhesive material is preferably a superabsorbent material for substantially solidifying liquid discharged into the container. The method preferably includes the step of applying indicia to an outer surface of the at least one outer wall member for advertising purposes. The method further preferably includes the steps of providing a blank having all of the above-discussed structural features singularly or in combination.

By the above, the present invention provides a foldable, self-standing cup which is substantially impervious to leaks and which is readily adaptable to be formed into and used as a foldable spittoon or cuspidor for tobacco chewers. The cup makes expeditious use of sheet material in its formation and provides a cup which is natural to drink from, hold, or stand upright. Should the cup be used as a cuspidor, it is conveniently sized to fit within most automotive cup holders and the use of superabsorbent material provides a container which will retain and substantially solidify any tobacco discharge expelled thereinto.

DESCRIPTION OF THE PREFERRED EMBODIMENT

Figure 1:
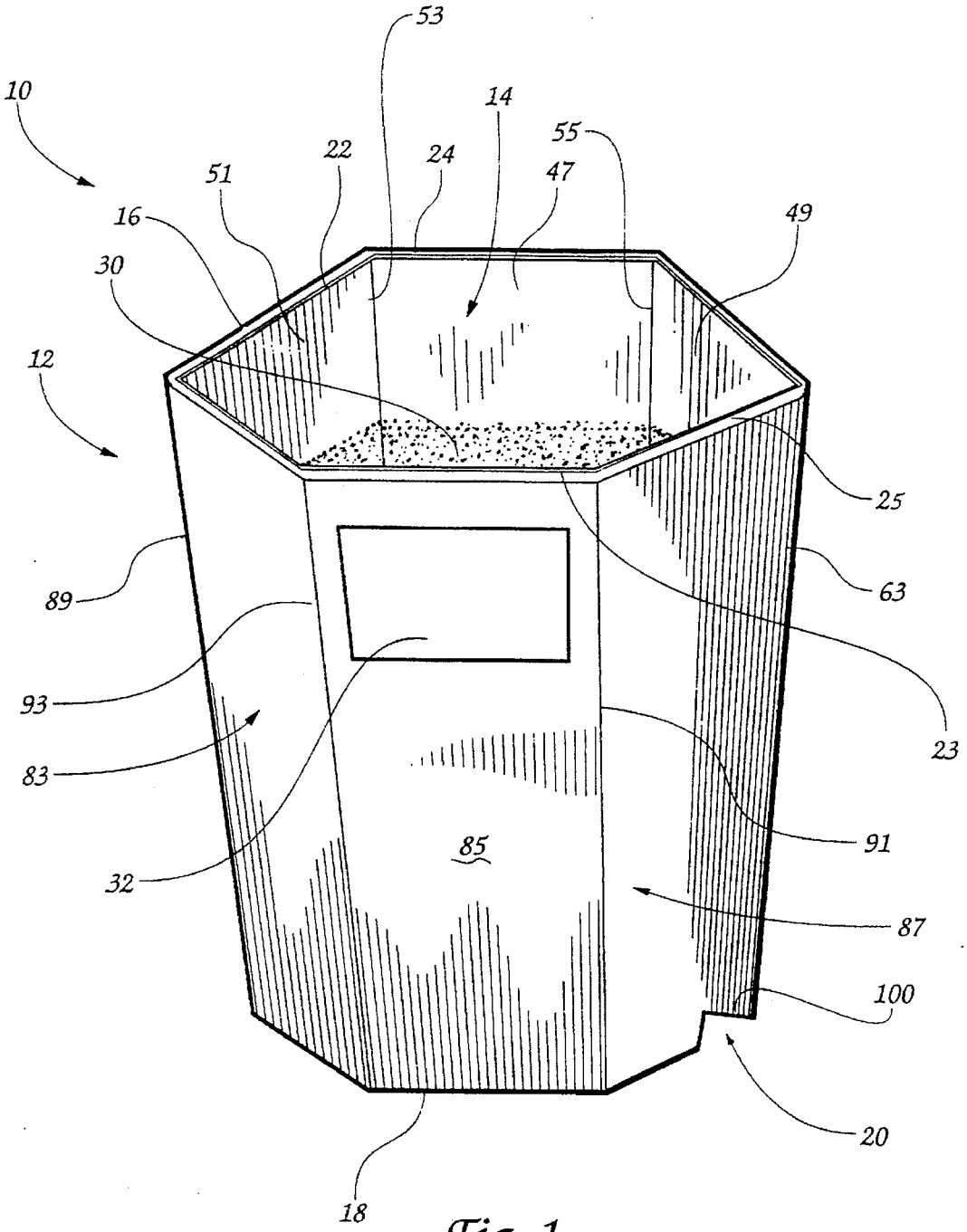
FIG. 1 is a perspective view of a hand-held, foldable container according to the preferred embodiment of the present invention.

Turning now to the drawings, and more particularly to FIG. 1, a foldable hand-held container according to the preferred embodiment of the present invention is illustrated generally at 10 and includes a generally frusto-conical shaped body portion 12 which extends from a top perimetorial rim portion 16 to a lower substantially perimetorial bottom support rim 18. The top rim 16 defines an access opening 14 allowing user access to the interior of the container 10. As will be seen in greater detail hereinafter, a notch 20 is formed in the container body 12 along the bottom rim 18 which, along with a similar, oppositely disposed notch (not shown), provides the only interruption in an otherwise continuous bottom rim 18. The body 12 is formed from two juxtaposed inner wall members 22, 23 surrounded by two outer wall members 80, 81 which extend in an overlapping manner to form the body 12 of the container 10. Each inner wall member 22, 23 and outer wall member 80, 81 are formed from a plurality of inner wall panels 46, 48, 50, 47, 49, 51, and a plurality of outer wall panels 83, 85, 87, 84, 86, 88. As will be seen, and as is exemplary of the overall construction, panels 83, 85, 87, seen as the container front in FIG. 1, are defined by a plurality of fold lines 63, 89, 91, 93, all of which will be explained in greater detail hereinafter.

Figure 2:
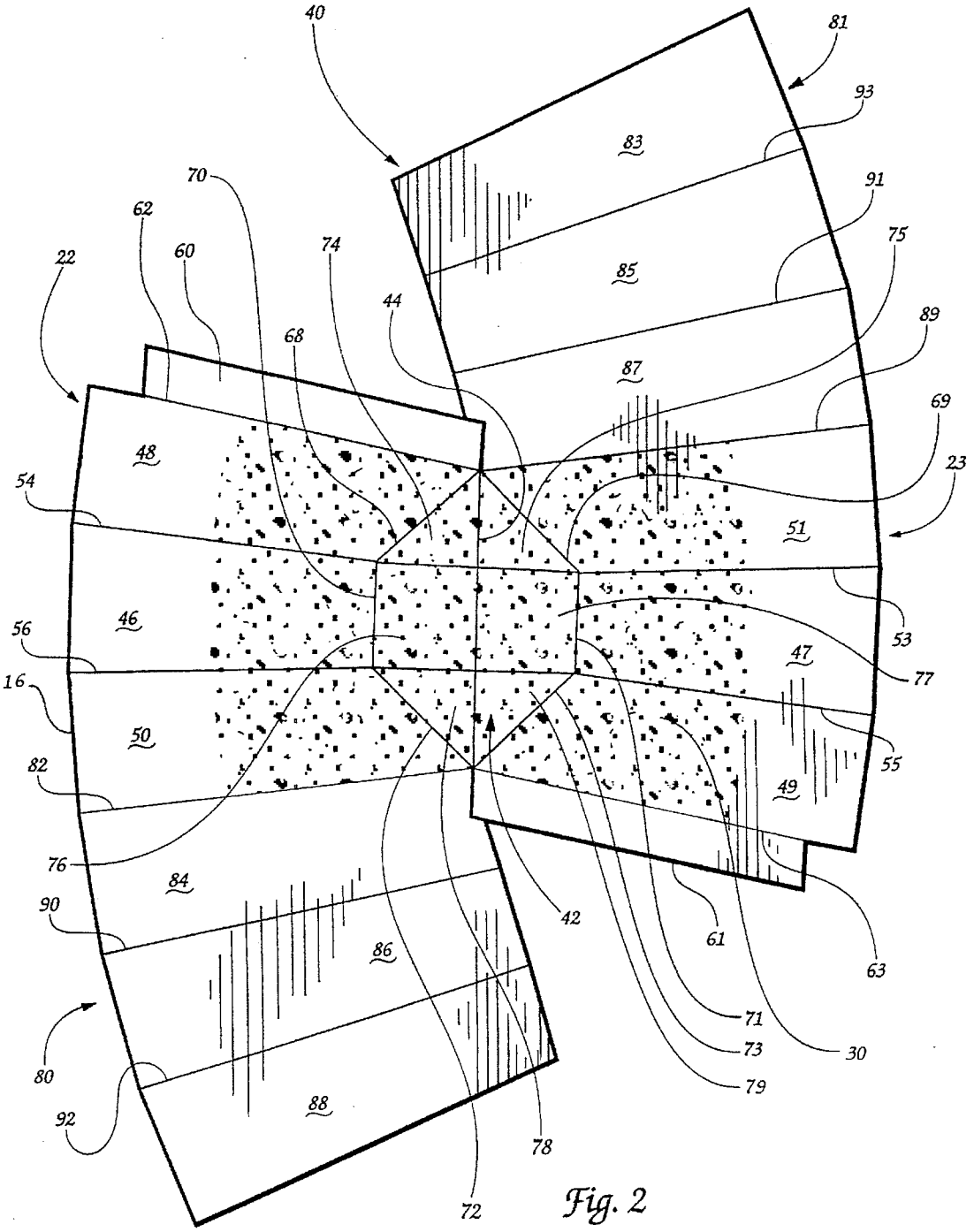
FIG. 2 is a plan view of a blank of foldable material configured to form the cup illustrated in FIG. 1.
Figure 4:
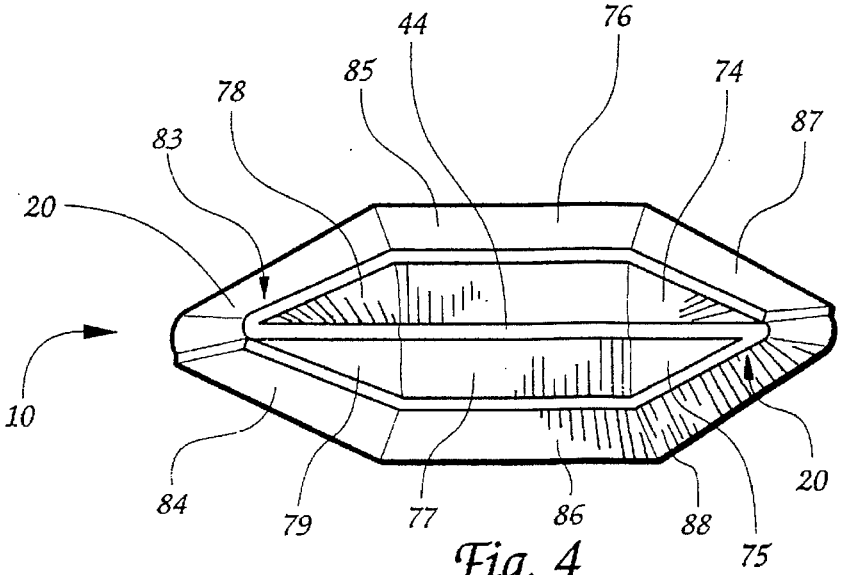
FIG. 4 is a bottom view of the container illustrated in FIG. 1 in an open condition.
Figure 5:
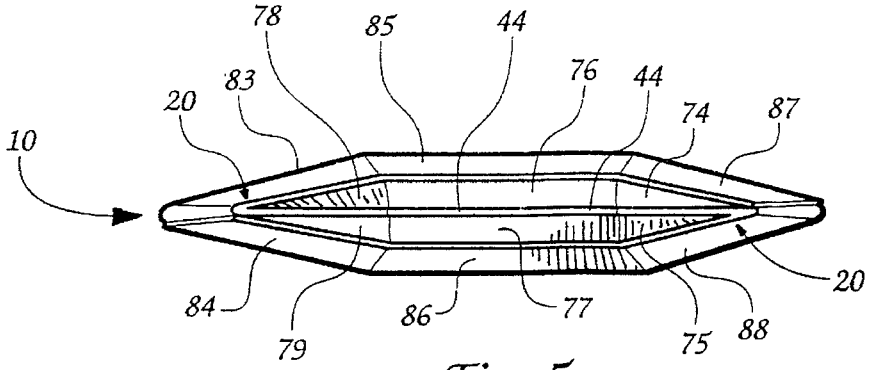
FIG. 5 is a bottom view of the container illustrated in FIG. 1 shown in a substantially closed position.

In order to allow the container 10 to be used as an effective cuspidor, and as best seen in FIGS. 1 and 2, an absorbent material 30 is fixedly adhered to the inner surfaces of the inner panels 46, 48, 50, 47, 49, 51 and, as will be seen, a bottom portion 42 of the container 10. In addition, in order to enhance the commercial appeal of the container 10 of the present invention, indicia 32, shown in FIG. 1 as a fictitious tobacco brand name, may be applied to the outer walls 28 of the container 10. In order to further enhance commercial appeal of the present invention, the container 10 is foldable between an open condition for use, as illustrated in FIGS. 1 and 4, and generally flattened, closed condition for non-use as illustrated in FIG. 5.

Figure 7:
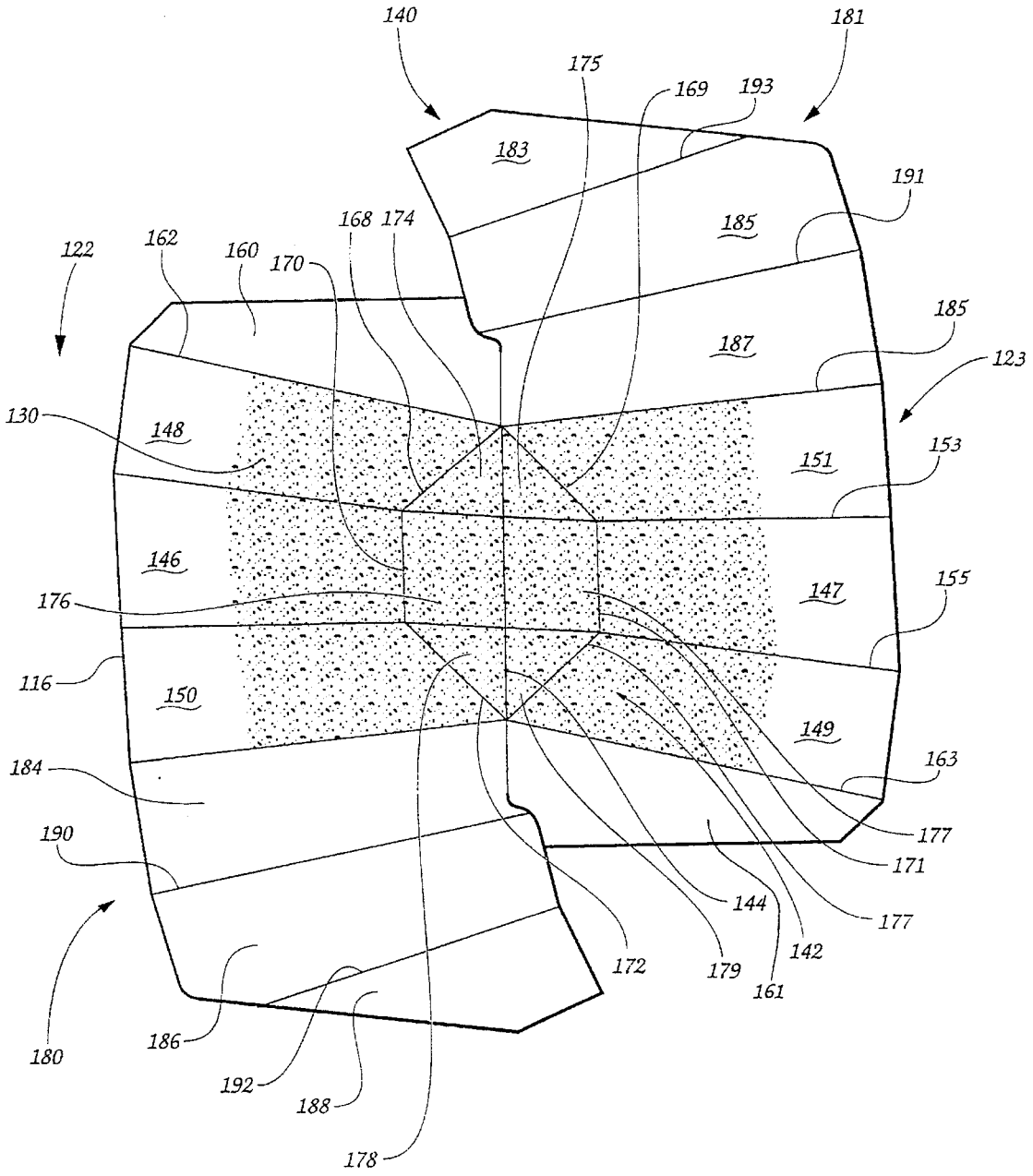
FIG. 7 is a plan view of an alternate embodiment of the blank used to form a container substantially similar to the container illustrated in FIG. 1.

The container 10 is formed from a single blank of foldable sheet material, preferably paperboard or some other inexpensive, disposable, and semi-rigid material. A blank according to one preferred embodiment of the present invention is illustrated generally at 40 in FIG. 2 and, according to a second preferred embodiment, at 140 in FIG. 7. It should be noted at the outset that the primary distinctions between the blank 40 illustrated in FIG. 2 and the blank 140 illustrated in FIG. 7 is that the blank 140 in FIG. 7 defines a smaller "footprint" than the blank 40 in FIG. 2. In this manner, more containers may be produced from a single sheet of blank material than are possible from the blank 40 illustrated in FIG. 2. Other slight distinctions will be manifest hereinafter. In any event, as understood by those skilled in the art, it should also be noted that the primary distinguishing features of the present invention may be formed on blanks of several different configurations and the description herein should in no way limit the present invention to one blank or another without regard to the structural limitations imposed by the claims of the present application. Further, while the majority of the discussion focuses on the blank in FIG. 2, it should be noted that, unless otherwise distinguished, the discussion with regard to the blank 40 illustrated in FIG. 2 is equally applicable to the blank 140 illustrated in FIG. 7.

Turning now to FIG. 2, the aforesaid blank 40 includes two opposed inner wall members 22, 23 which are mirror images of one another and are disposed oppositely from one another, being divided by a multi-member bottom portion 42 and a primary fold line 44 which bisects both the bottom portion 42 and the inner wall members 22, 23 while defining a primary fold axis. Each inner wall member 22, 23 is formed from three panels, an inner wall center panel 46,47, an inner wall inboard panel 48, 49, and an inner wall outboard panel 50, 51. Each panel 46, 47, 48, 49, 50, 51 is formed as a quadrilateral and includes a portion of the bottom portion 42 as a component thereof. The panels 46, 47, 48, 49, 50, 51 are contiguous and are joined by fold lines 53, 54, 55, 56 or score lines formed in the blank 40 of material. The inner wall center panels 46, 47 are bordered and defined by first center fold lines 54, 55 which are disposed intermediate the inner wall center panels 46, 47 and the inner wall inboard panel 48, 49. Similarly, second fold lines 53, 56 are disposed intermediate the inner wall outboard panels 50, 51 and the center panels 46, 47. All center member defining fold lines 53, 54, 55, 56 extend from the primary fold line 44 in a diverging relationship outwardly to the outer rim 16, which is defined by the outer terminus of all wall members. The diverging, equidistant fold lines define panels which are equally sized quadrilaterals. This, in combination with the overall configuration of the panels, give the container 10 its distinctive tapered shape, thereby adding a more natural, stable feeling in use, as well as enhancing the ability of the cup to be received with stability in automotive cup holders.

Generally rectangular sealing flaps 60, 61 project outwardly from the inner wall outboard panels 48, 49 and each are approximately one-third the width of any panel. The sealing flaps 60, 61 extend from the primary fold line 44 to a position adjacent the outer rim 16. The length of the sealing flaps 60, 61 is dependent upon the desired amount of adhesive, as will be seen, since the sealing flap 60, 61 is a key adhesive depository, as will also be seen. Sealing flap fold lines 62, 63 are formed in the blank 40 to extend from the primary fold line 44 to the end portion of the sealing flaps 60, 61. While the sealing flaps 60, 61 are depicted as rectangular in FIG. 2, in FIG. 7, the sealing flaps 160, 161 are of an irregular configuration. Sealing flap shape is not of particular importance, yet the sealing flaps 60, 61 should be of sufficient area to carry a necessary amount of adhesive and that the sealing flap fold lines should extend from the primary fold line 44.

The bottom portion 42 is formed in the inner wall members 22, 23 and is defined by a polygonal arrangement of fold lines, some of which intersect the primary fold line 44. The bottom portion 42 defines a hexagonal figure with three sides extending into the first inner wall member 22 and three sides extending into the second inner wall member 23. Accordingly, and with reference to the first inner wall member 22, a first end fold line 68 extends angularly away from an intersection point defined by the junction of the primary fold line 44 with the first inner wall outboard panel 48 and the sealing flap 60 to a point along the first center panel fold line 54. A second end fold line 72 extends from an intersection of the primary fold line 44, the first inner wall inboard panel 50, and the opposing sealing flap 61 angularly to an intersection with the second center panel fold line 56 at a position in a spaced, opposing relationship with the first end fold line 68. A side fold line 70 extends from the end point of each end fold line 68, 72 across the center panel 46. Since the first and second center panel fold lines 54, 56 extend from the rim 16 to the primary fold line 44, these fold lines 54, 56 in conjunction with the primary fold line 44, the first and second end fold lines 68, 72, and the side fold lines 70 define three distinct bottom members, a first end bottom member 74, formed as a triangle, a center bottom panel 76 which is formed as a parallelogram, and a second end bottom member 78, formed as a triangle. Corresponding end fold lines 69, 73 and a corresponding side fold line 71 are formed in the second inner wall member 23 to form second end bottom members 75, 79 and a second center bottom member 77, all of which are configured like their mirror-image counterparts formed in the first inner wall member 22.

The blank also includes an outer wall structure. To that end, a first outer wall member 80 is formed integrally with and extends away from the first inner wall member 22 and is separated therefrom by an outer wall, or edge, fold line 82. The outer wall member 80 is formed similarly to the first inner wall member 22 and includes three panels, an outer wall inboard panel 84, an outer wall center panel 86, and an outer wall outboard panel 88. The outer center panel 86 is separated from the other two outer wall panels 84, 88 by fold lines 90, 92 which extend the full width of the outer wall member 80 and extend in an equidistant diverging relationship to the rim 16. It should be noted that of the panels 46, 48, 50, 84, 86, 88 of the inner wall member 22 and the outer wall member 80 form quadrilaterals of equal size. The outer wall inboard panel 84 includes a portion of the primary fold line 44 and the opposing sealing flap 61 so that, as will be seen, when the blank 40 is folded into a container-like configuration, a notch 20 will be formed in the outer wall inboard panel 84, as seen in FIG. 1, which is likewise true of the other outer wall inboard subpanel 87. The width 20 results from the primary fold line 44 extending along the sealing flaps 60, 61 beyond the inner panels 46, 47, 48, 49, 50, 51 thusly interrupting an outer panel 84, 87 adjacent the inner panels 50, 51. A notch 20 thereby extends a predetermined distance, i.e., the width of a sealing flap 60, 61, along two outer wall panels 84, 87. Otherwise, all panels are of identical dimensional configuration. Since this is the case, and since all fold lines 54, 56, 62, 82, 90, 92 extend in a equidistant diverging relationship with one another, the inner and outer wall members 22, 80 extend in a curved, fan-like configuration. Therefore, since the first inner wall member 22 is disposed oppositely from the second inner wall member 23 and these members are joined by the primary fold line 44, the outer wall member 80 projects from the inner wall member 22 in a generally curved relationship.

In accordance with the mirror image relationship of the blank, a second outer wall member 81 projects outwardly from the second inner wall member 23 and includes panels 83, 85, 87 separated by fold lines 91, 93 and the second outer wall member 81 is formed integrally with and separated from the second inner wall member 23 by a fold line 89, in a manner described above. From a blank formed in accordance with the foregoing, a container may be formed.

Turning to FIG. 7, a second embodiment of the blank is illustrated generally at 140 and includes corresponding wall members, including quadrilateral panels, which are designated with reference numerals corresponding to those of the first blank 40 increased by 100. However, the sealing flaps 161, 162 are somewhat larger than the sealing flaps of the first embodiment. Further, the outboard panels 188, 187 are formed with an angular edge. This results in the outer wall member panels not being of equal size. However, the equidistant diverging relationship of the key fold lines is maintained such that the tapered structure of a cup is maintained. As stated earlier, the second embodiment is designed to provide manufacturers with the optimum blank configuration to obtain the most blanks from a single sheet of container material. As can be seen in a comparison of FIGS. 2 and 7, the angular open areas intermediate the sealing flaps and the outer wall members are smaller in FIG. 7 than in FIG. 2, thus reducing scrap after a blank is cut from a sheet of material. Further, by removing a portion of each outer wall member, the overall footprint of the blank on a material sheet is smaller.

In order to use the container as a cuspidor, a superabsorbent material 30 is applied to inner surfaces of the inner wall members 22, 23, as seen in FIG. 2. The superabsorbent material preferentially may be FAVOR® SXM 75 available from Stockhausen, Incorporated. The superabsorbent material 30 is a granular material which is adhered to the inner surfaces of the inner wall members 22, 23 using a contact adhesive which is applied to the inner wall members 22, 23 in a predetermined pattern extending from the primary fold line 44 to a position adjacent the rim 16, covering approximately two-thirds of the area of the inner wall members 22, 23 to include the bottom portion 42. The superabsorbent material 30 is activated upon contact with liquid and, accordingly, any liquid within the tobacco/saliva mixture discharged into the cup will be absorbed and solidified by the superabsorbent material 30. Accordingly, when using the container as a cuspidor, the tobacco discharge is substantially solidified and therefore the danger of spillage is virtually eliminated, making the present invention useful for outdoor sporting events and travel. Further, the preferred embodiment of the present invention is sized to fit within conventional cup-holders which are prevalent in today's vehicles.

According to the method of the present invention, a container 10 formed from a blank 40 according to the foregoing description is constructed. Initially, a plurality of blanks 40 are formed from a sheet of stock material. The material may be paperboard and it may be waxed or otherwise coated to further prevent leaks. An adhesive is applied to the inner wall members 22, 23 in a predetermined pattern which preferably extends over the entire bottom portion 42 and the inner panels 46, 48, 50, 51, 47, 49 to the extent that approximately two-thirds of the area of the inner wall members 22, 23 is covered with adhesive. Nevertheless, those skilled in the art will appreciate that the adhesive pattern may be of a number of patterns as desired. Secondly, the adhesive is exposed to an ultraviolet light which instantly dries the adhesive onto the blank. The adhesive used is a pressure sensitive adhesive and once the adhesive is dried to the blank 40, the superabsorbent material is sprayed on in its granular form and, accordingly, adheres to the pressure sensitive adhesive. A container sealing adhesive is then applied to the sealing flaps 60, 61 and the inner surfaces of the outer wall members 80, 81.

Figure 3:
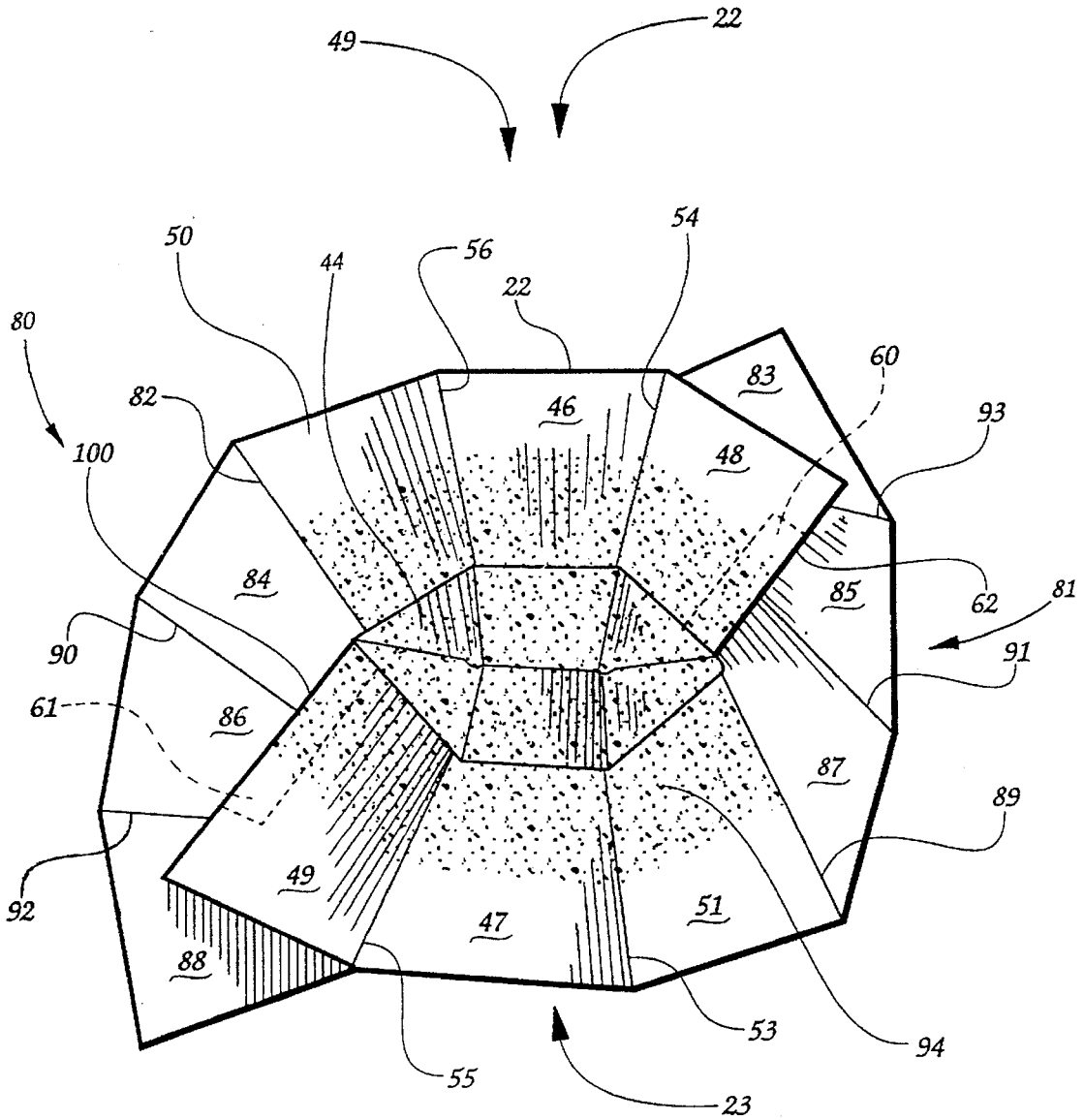
FIG. 3 is a plan view of the blank of material during an intermediate folding stage being formed into the cup illustrated in FIG. 1.

The blank 40 is then folded in half along the primary fold axis defined by the primary fold line 44 to the extent that the first and second inner wall members 22, 23 are in a spaced, opposing relationship defining a cavity therebetween. Next, and with reference to FIG. 3, the outer wall members 80, 81 are wrapped around the opposing inner wall members 22, 23 such that a first inner wall member 22 has thereagainst the second outer wall member 81 and the second inner wall member 23 has thereagainst the first outer wall member 80. Due to the positioning of the sealing flaps 60, 61, the adhesive on the inner surface thereof is applied against the wall inner outboard panels 84, 87 and the folding of the outer wall members 80, 81 around the inner wall members 22, 23 causes the sealing flaps 60, 61 to be folded in a reverse manner, that is, to be folded back against the corresponding inner wall member 22, 23 to be disposed intermediate the inner wall members 22, 23 and the outer wall members 80, 81, as shown in dotted lines in FIG. 3. A foldable container 10 is thereby provided which is foldable between a closed, flattened condition as seen in FIGS. 5 and 6 and an open condition as seen in FIGS. 1 and 4.

Figure 8:
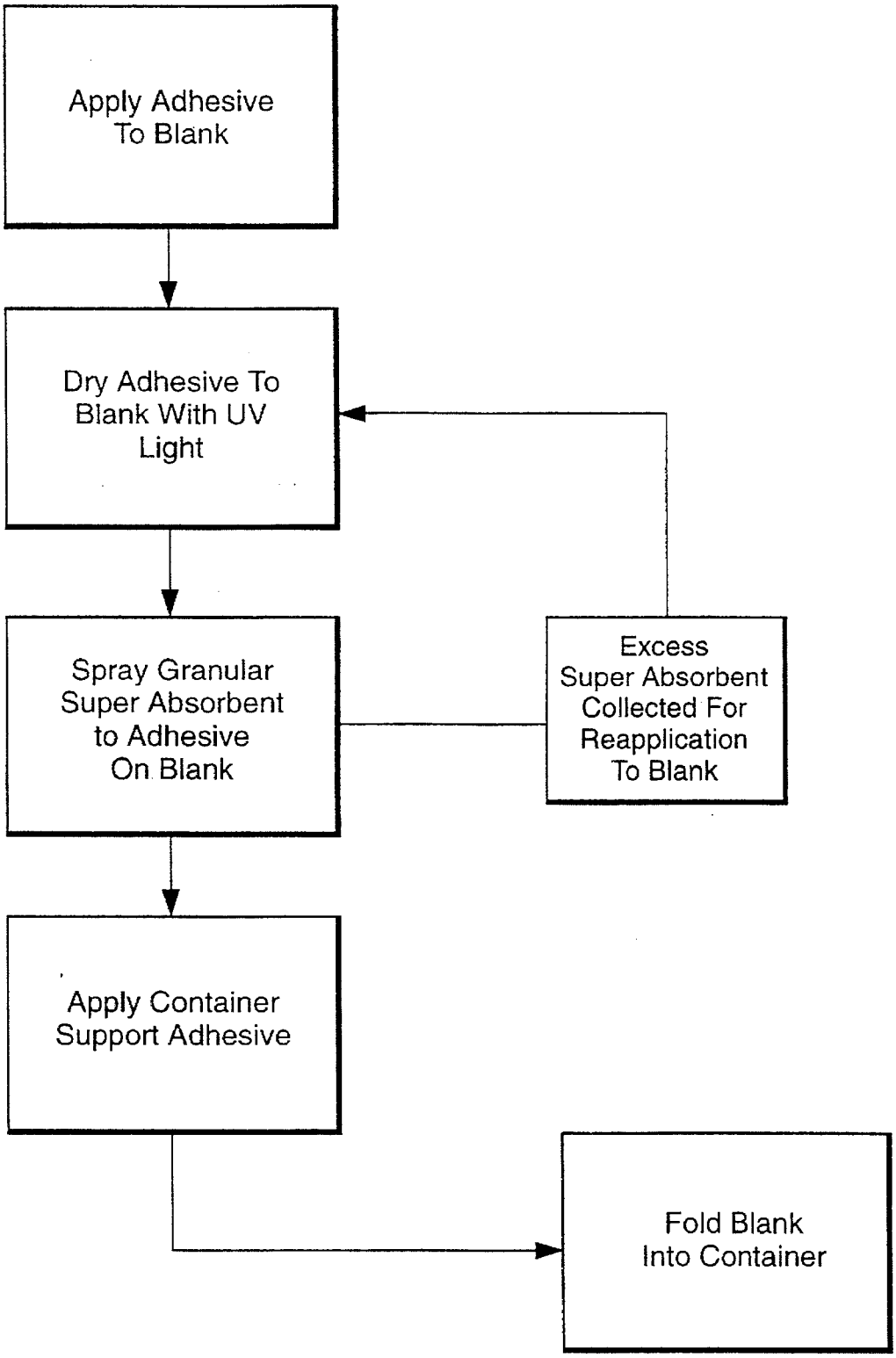
FIG. 8 is a diagrammatical representation of the manufacturing process associated with the present invention.

Several types of packaging machinery may be adapted to form the container of the present invention, however, it is contemplated that a machine will be used that is dedicated to the construction of the containers. As diagrammatically depicted in FIG. 8, the adhesive application to the blank 40 is performed by a slotted applicator nozzle across which the blank 40 is drawn. From there, an ultraviolet light dries the adhesive in a manner previously described. The superabsorbent material, in granular form, is sprayed on using nozzles and the excess material is collected and recycled back into the superabsorbent supply. From there, the container support adhesive is applied to the sealing flaps, the outer or inner wall members, or both. From there, conventional folding equipment can be configured to fold the cup in half and wrap the outer walls around the folder inner walls, in a manner described previously. It is estimated that by using such production techniques, twenty thousand to thirty thousand containers can be produced per hour.

Figure 6:
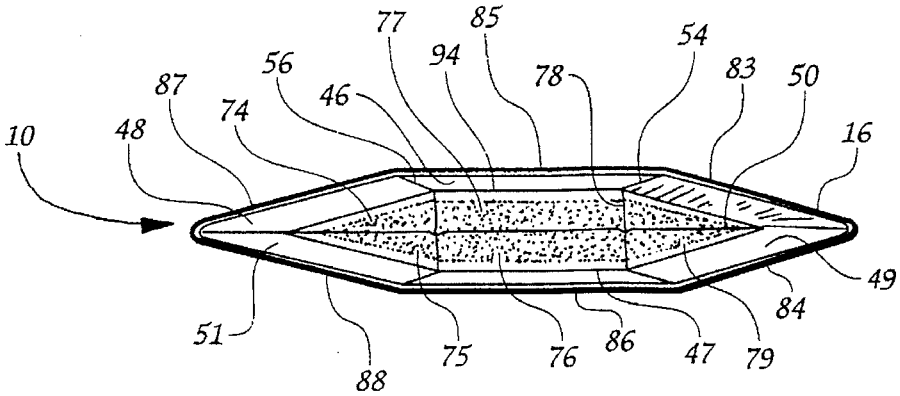
FIG. 6 is a plan view of the container illustrated in FIG. 1.

In order to use the container, it is unfolded from its flattened condition as seen in FIGS. 5 and 6 to its opened condition as seen in FIGS. 1 and 4, with the bottom portion rising up into the container area. This presents a level portion defined by the center bottom members 76, 77 which drops off into adjacent wells defined by the triangular shaped bottom portions and the adjacent panels. Accordingly, drainage into these areas tends to collect at a collection point 100 whose construction provides no horizontal channels which are joined by adhesive. The only horizontal channels formed are formed at fold lines and, therefore, any liquid remaining in the cup cannot seep horizontally along an adhesive fold line to cause the cup to separate and leak. Therefore, the fluid containing properties of the container are enhanced.

By the above, the present invention provides a hand-held collapsible container which may be effectively used as a cuspidor or, in the absence of superabsorbent material, may be used as a drinking cup. It is also contemplated that the commercial possibilities for such a container are wide due to its conventional, cup-like appearance and handling, its taper which allows it to be more conveniently held, manipulated, and retained in a cup holder and its foldability which enhances its use for travel. Further, the double-wall construction and the aforesaid collection points enhance the ability of the container to hold liquid. Finally, the container is inexpensive to manufacture. It is contemplated that the container may be sold with effervescent medicinal tablets, with other conventional medications, and when included with the superabsorbent material, may be sold with smokeless tobacco products. In that vein, the ability to print advertising indicia on the outer portion of the cup enhances its commercial appeal.

It will therefore be readily understood by those persons skilled in the art that the present invention is susceptible of broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

We claim:

1. A foldable hand-held container comprising a generally frusto-conical body formed from a sheet of foldable material including two opposed inner wall members having a plurality of fold lines formed therein defining a plurality of panels and a polygonal bottom portion formed in said panels and defined by a plurality of generally parallel side fold lines and a plurality of converging end fold lines with said panel fold lines extending in a substantially equidistant diverging relationship to distal ends of said members, with outer ends of said panels forming a container rim and defining a container access opening thereat;

a primary fold line defining primary fold axis and generally bisecting said bottom portion;

a pair of sealing flaps projecting laterally outwardly from said inner wall members with a fold line extending between each said sealing flap and said wall member associated therewith;

and at least one outer wall member projecting laterally outwardly from at least one said inner wall member and being adhered to and juxtaposed with at least one said inner wall member with at least one of said sealing flaps being disposed between said at least one outer wall member and at least one of said inner wall members for substantially sealing a junction between said at least one outer wall member, at least one of said inner wall members, and said bottom portion for rendering said container substantially impervious to leaks, said container being foldable between a closed condition for nonuse and an open condition for use.

2. A foldable hand-held container according to claim 1 wherein said container is configured for use as a cuspidor and includes absorbent means fixed to at least one of said members for absorbing and retaining tobacco discharge deposited in said container.

3. A foldable hand-held container according to claim 2 wherein said bottom portion includes a plurality of bottom members with at least one of said bottom members being oriented substantially horizontally when said container is oriented substantially upright in said opened condition and includes said absorbent means affixed thereto.

4. A foldable hand-held container according to claim 2 wherein said absorbent means is a superabsorbent material for substantially solidifying liquid discharged into said container, said superabsorbent material being fixed to said inner wall members and said bottom portion in a predetermined pattern.

5. A foldable hand-held container according to claim 4 wherein said predetermined pattern extends intermediate said fold lines.

6. A foldable hand-held container according to claim 1 wherein said bottom defining fold lines converge to a point along said primary fold axis, at least one of said sealing flap fold lines converge to said point with a portion of each said sealing flap extending along said primary fold axis from said point to an end of each said sealing flap in an inclined manner when said container is in said opened condition.

7. A foldable hand-held container according to claim 4 wherein said bottom portion includes a plurality of bottom members with at least one of said bottom members being oriented substantially horizontally when said container is oriented substantially upright in said opened condition, with two of said bottom members being contiguous with said horizontally oriented member and projecting angularly downwardly from said horizontally oriented member to said point.

8. A foldable hand-held container according to claim 1 wherein said bottom portion includes a plurality of bottom members and at least one of said members is oriented substantially horizontally when said container is in said opened condition.

9. A foldable hand-held container according to claim 1 wherein said outer wall member projects beyond said bottom portion to form a substantially continuous base rim for supporting said container in a generally upright condition on a support surface.

10. A foldable hand-held container according to claim 1 wherein said at least one outer wall member includes an outer wall member extending laterally from each inner wall member, each said outer wall member including three members defined by converging fold lines in each said outer wall member, said converging fold lines extending in a substantially equidistant, spaced relationship with each said outer wall member being in abutment with a respective one of said inner wall panel.

11. A foldable hand-held container according to claim 1 wherein said container is formed of paper stock and includes a lining fixed to said inner wall members, said lining being formed from a material substantially impervious to liquid penetration.

12. A foldable hand-held container according to claim 1 wherein said container is formed of a stock material substantially impervious to liquid penetration.

13. A foldable hand-held container according to claim 1 and further comprising means for conveying information associated with said container body.

14. A foldable hand-held container according to claim 13 wherein said information conveying means includes indicia printed on said at least one outer wall member for advertising purposes.

15. A blank of foldable sheet material for forming a hand-held foldable container having a generally frustoconical body, said blank comprising two inner wall members joined by a primary fold line, each said inner wall member formed from a plurality of quadrilateral panels, said panels being defined by a plurality of fold lines, said fold lines extending in a diverging, spaced, equidistant relationship from said primary fold line to an end portion of said inner wall members;

a bottom portion formed in said inner wall members and defined by a plurality of interconnected side fold lines and end fold lines, said end fold lines intersecting said primary fold line and said side fold lines extending between said end fold lines;

at least one outer wall member extending outwardly from at least one of said inner wall members and including a plurality of panels, said panels being defined by a plurality of fold lines extending in a diverging, spaced, equidistant relationship across said at least one outer wall member; and two sealing flaps, with each said sealing flap extending outwardly from a respective one of said inner wall members and joined thereto along a sealing fold line, each said sealing fold line extending in a spaced equidistant diverging relationship with one of said panel fold lines;

said blank being foldable along said primary fold line to bring said inner wall members into juxtaposition with said bottom portion extending therebetween to define a tapered cavity and said sealing flaps being reverse foldable along the sealing fold line to bring said flaps into abutment with said inner wall members, and said at least one outer wall member being foldable across said inner wall members with said sealing flaps disposed intermediate said inner wall members and said outer wall members to define a foldable hand-held container.

16. A blank of foldable sheet material for forming a hand-held foldable container according to claim 15 wherein said sealing flaps include an adhesive applied thereto to retain said container in a folded container-forming condition substantially impervious to leaks.

17. A blank of foldable sheet material for forming a hand-held foldable container according to claim 16 wherein said inner wall members and said bottom portion includes an absorbent material adhered thereto and disposed therealong to be within said tapered cavity to provide a container for use as a cuspidor, said absorbent material being for the absorptive retention of oral discharge material deposited into said container.

18. A blank of foldable sheet material for forming a hand-held foldable container according to claim 15 wherein said blank includes one outer wall member extending from each said inner wall member and joined thereto along an edge fold line, said edge fold line extending in a spaced equidistant relationship with said panel fold lines, each said outer wall member curving laterally away from each respective inner wall member and being foldable across opposing inner wall members when forming said container.

19. A blank of foldable sheet material for forming a hand-held foldable container according to claim 15 wherein said outer wall members extend beyond said fold lines forming said bottom portion when said blank is formed into said container, with said container in said folded condition to form support walls for supporting said folded container in an upright disposition.

20. A blank of foldable sheet material for forming a hand-held foldable container according to claim 15 wherein said blank forms a container configured for use as a cuspidor and includes absorbent means fixed to at least one of said members for absorbing and retaining tobacco discharge deposited in said container.

21. A blank of foldable sheet material for forming a hand-held foldable container according to claim 20 wherein said bottom portion includes a plurality of bottom members with at least one of said bottom members being oriented substantially horizontally when said blank forms a container oriented substantially upright in an opened condition and includes said absorbent means affixed thereto.

22. A blank of foldable sheet material for forming a hand-held foldable container according to claim 21 wherein said absorbent means is a superabsorbent material for substantially solidifying liquid discharged into said container and is fixed to said inner wall members and said bottom portion in a predetermined pattern.

23. A blank of foldable sheet material for forming a hand-held foldable container according to claim 22 wherein predetermined pattern extends intermediate said fold lines.

24. A blank of foldable sheet material for forming a hand-held foldable container according to claim 15 wherein said bottom defining fold lines converge to a point along said primary fold line, at least one of said sealing flap fold lines converge to said point with a portion of each said sealing flap extending from said primary fold line from said point to an end of each said sealing flap in an inclined manner when said container is in an opened condition.

25. A blank of foldable sheet material for forming a hand-held foldable container according to claim 22 wherein said bottom portion includes a plurality of bottom members with at least one of said bottom members being oriented substantially horizontally when said container is oriented substantially upright in said opened condition with two of said bottom members being contiguous with said horizontally oriented member and projecting angularly downwardly from said horizontally oriented member to said point.

26. A blank of foldable sheet material for forming a hand-held foldable container according to claim 15 wherein said bottom portion includes a plurality of bottom members and at least one of said bottom members is oriented substantially horizontally when said container is in said opened condition.

27. A blank of foldable sheet material for forming a hand-held foldable container according to claim 15 wherein each inner wall member includes one said outer wall member extending laterally therefrom, each said outer wall member including three members defined by diverging fold lines in each said outer wall member, said diverging fold lines extending in a substantially equidistant, spaced relationship along each said outer wall member.

28. A blank of foldable sheet material for forming a hand-held foldable container according to claim 15 wherein said blank is formed of paper stock and includes a lining fixed to said inner wall members, said lining being formed from a material substantially impervious to liquid penetration.

29. A blank of foldable sheet material for forming a hand-held foldable container according to claim 15 wherein said container is formed of a stock material substantially impervious to liquid penetration.

* * * * *